US006402870B1

(12) United States Patent
Groten et al.

(10) Patent No.: US 6,402,870 B1
(45) Date of Patent: Jun. 11, 2002

(54) PROCESS OF MAKING MULTI-SEGMENTED FILAMENTS

(75) Inventors: Robert Groten, Sundhoffen; Jean Baravian, Decines; Georges Riboulet, Colmar, all of (FR)

(73) Assignee: Firma Carl Freudenberg, Weinheim (DE)

( * ) Notice: Subject to any disclaimer, the term of this patent is extended or adjusted under 35 U.S.C. 154(b) by 0 days.

(21) Appl. No.: 09/515,866

(22) Filed: Feb. 29, 2000

(30) Foreign Application Priority Data

Mar. 1, 1999 (FR) ..... 99 02601

(51) Int. Cl.[7] ..... D01D 5/098; D04H 3/16

(52) U.S. Cl. ..... 156/167; 156/229; 156/244.11; 156/256; 264/147; 264/171.1; 264/210.8

(58) Field of Search ..... 156/167, 229, 156/244.11, 256; 264/147, 171.1, 210.8

(56) References Cited

U.S. PATENT DOCUMENTS 3,690,978 A * 9/1972 Nishizawa et al. ..... 156/167
4,325,765 A * 4/1982 Yu et al. ..... 156/167
5,814,176 A * 9/1998 Proulx ..... 156/167

* cited by examiner

*Primary Examiner*—Leo B. Tentoni
(74) *Attorney, Agent, or Firm*—Kenyon & Kenyon

(57) ABSTRACT

Method and apparatus for producing multi-segmented filaments are provided. In one embodiment a first polymer material is passed into a die, the first polymer material and the die being maintained under predetermined rheological conditions. Next, the first polymer material is extruded through a plurality of die openings in the die, the die openings arranged in a group, the group configured to form at least two elementary filaments. Then, the two elementary filaments are connected to one another by adhesion contact to form a multi-segmented filament. In another embodiment a die for producing multi-segmented filaments is provided. This die comprises a polymer source maintaining a polymer under predetermined rheological conditions. A die in communication with the polymer source, the die maintaining the polymer under predetermined rheological conditions and a die plate in fluid communication with the die, the die plate defining a first group of openings, the first group comprising a first opening and a second opening, the first opening and the second opening configured to form a first elementary fiber having a skin and a second elementary fiber having a skin.

13 Claims, 2 Drawing Sheets

PROCESS OF MAKING MULTI-SEGMENTED FILAMENTS

CLAIM OF FOREIGN PRIORITY

This application claims priority to French Application No. FR P 9902601 filed on Mar. 1, 1999, and incorporates that application herein by reference.

FIELD OF THE INVENTION

The present invention regards man made filaments. More specifically the present invention regards method and apparatus for producing multi-segment filaments, multi-segment filaments themselves, and textiles formed with multi-segmented filaments.

BACKGROUND

Multi-segmented filaments are man made tendrils made from polymers. Numerous processes are presently known for the production of these multi-segmented filaments or fibers. Some of these known procedures extrude the filaments directly from the raw materials while others utilize recycled materials, such as non-woven textile surfaces, to create the multi-segmented filaments. In one known production process, thermoplastic polymer materials are co-extruded through divided spinning die openings to form the desired multi-segment filament forms. Such a process, however, results in mono-filaments, which suffer from numerous restrictions and disadvantages, being formed. For example, it is difficult to separate the multi-segment mono-filaments into more basic elementary filaments. If required, machines are utilized to attempt this separation. Unfortunately, these machines, which are not always successful in separating the filaments, are cumbersome as they must be able to develop significant concentrated forces in order to carry out the separation. In fact, in some circumstances, such as when the elementary filaments are formed from the same polymer or from chemically compatible polymers, their separation back into their original state is impossible to carry out. Similarly, when materials in their miscible state are used to create multi-segmented filaments, they, too, may also be impossible to separate into a filament state.

In addition, known technology only offers a limited number of shapes and titers for the manufacture of multi-segmented filaments due to: the complexity of the feed circulations in the dies; the low limit conditions of spinning and extrusion for the fine-titer filaments or fibers; the physical impossibilities that result from co-extrusion; and the exorbitant costs associated with manufacturing the required spinning dies.

Further to these obstacles, it is also not possible with current technologies, to achieve complex external cross-sections having clear outlines such as edges and notches. Due to the rheological properties of polymers these edges and notches fade during this known co-extrusion manufacturing process.

SUMMARY OF THE INVENTION

Multi-segmented filaments and method and apparatus for producing multi-segmented filaments are provided. In one embodiment a first polymer material is passed into a spinning die, the first polymer material and the spinning die being maintained under predetermined rheological conditions. Next, the first polymer material is extruded through a plurality of die openings in the die, the die openings arranged in a group, the group configured to form at least two elementary filaments. Then, the two elementary filaments are connected to one another by adhesion contact to form a multi-segmented filament.

In another embodiment a die for producing multi-segmented filaments is provided. This die comprises a polymer source maintaining a polymer under predetermined rheological conditions; a die in communication with the polymer source, the die maintaining the polymer under predetermined rheological conditions; and a die plate in fluid communication with the die, the die plate defining a first group of openings, the first group of openings comprising a first opening and a second opening, the first opening and the second opening configured to form a first elementary fiber having a skin and a second elementary fiber having a skin.

In yet another alternative embodiment a multi-segmented filament is provided. This filament comprises a first elementary fiber having a skin and a second elementary fiber having a skin. In this embodiment the first elementary fiber is connected longitudinally to the second elementary fiber by adhesion of the skin of the first elementary fiber with the skin of the second elementary fiber.

BRIEF DESCRIPTION OF THE DRAWINGS

The various features of the invention will be best appreciated by simultaneous reference to the description which follows and the accompanying drawings in which.

DETAILED DESCRIPTION

Figure 1:
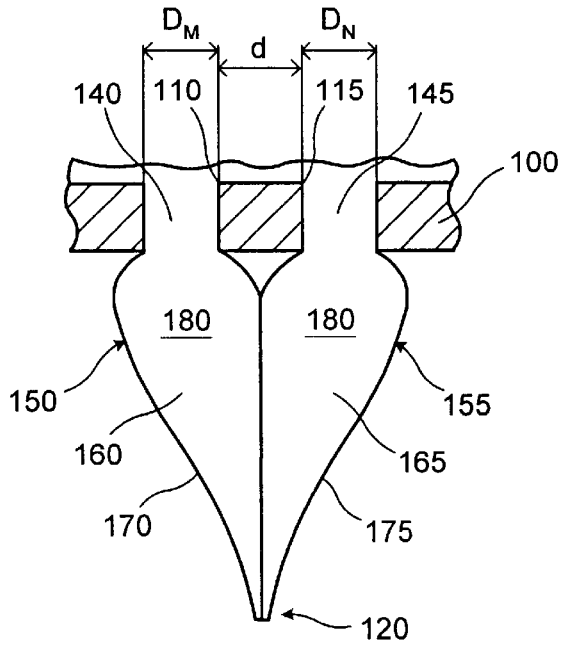
FIG. 1 is a partial cross-sectional view of a die plate being operated in accord with a first embodiment of the present invention.

FIG. 1 illustrates a die in accord with a first embodiment of the present invention. In FIG. 1 a die plate 100 having a first opening 140 and a second opening 145, both of which penetrate through the die plate 100, is shown. As is evident, the first opening 140 and the second opening 145 are equally sized and parallel to one another. As is also evident a point 110 located on the perimeter of the first opening 140 and a point 115 located on the perimeter of the second opening 145 are also illustrated in FIG. 1. As will be discussed in more detail below, these points, 110 and 115, mark the shortest distance between the two openings 140 and 145. Therefore, the marker "d" in FIG. 1 marks the shortest distance between points 110 and 115 and concomitantly the shortest distance between the first opening 140 and the second opening 145. Also illustrated in FIG. 1 is a polymer 180, a first bead 150 and a second bead 155, elementary filaments 160 and 165, skins 170 and 175 and multi-segmented filament 120.

In accord with the first embodiment of the present invention, the polymer 180 is fed into the spinning die under favorable rheological conditions, examples of which are provided below. After entering the spinning die the polymer 180, is then extruded through both openings. These openings, the first opening 140 and the second opening 145, are arranged as a group on the die plate 100 in order to form a set of two elementary filaments 160 and 165 when the polymer is drawn through the die. Once drawn through the die, these elementary filaments, in this case the first elementary filament 160 and the second elementary filament 165, come in contact with one another and are adhered to one another through the adhesion contacts of their skins 170 and 175. Once adhered, the two elementary filaments now constitute the multi-segmented filament 120. By adhering the elementary filaments together through the adhesion of their skins 170 and 175 phase mixing of adjacent elementary filaments is reduced if not eliminated. Once drawn, this multi-segmented filament 120 is then consolidated with other multi-segmented filaments, stretched, and passed on to subsequent processing or treatment steps. These steps can include the production of thicker filaments, the spooling of the filaments, the combination of the filaments into cables, and the manipulation of the filaments into non-woven textiles.

Therefore, contrary to the current co-extrusion technology, in which the miscible phases of the various components come in contact with one another in a single opening for each multi-segmented filament, this first embodiment of the present invention extrudes the polymer through independent die openings 140 and 145. Elementary filaments 160 and 165 are, therefore, formed independent of one another. These elementary filaments may make contact with one another after exiting the die openings 140 and 145 and, consequently, after their viscosities have begun to change and their phases have begun to be delimited by their skins 170 and 175.

The multi-segmented filament 120 produced by this first embodiment has a cohesive force holding the elementary filaments 160 and 165 together. This cohesive force is derived from the adhesion contact of the border surface zones or skins of the elementary filaments while they were still sufficiently plastic and adherent to create an adhesive surface bond. Due to this adhesive surface bond, the phase mixing in the region of contact of the skins 170 and 175 can be sufficiently consolidated to be limited to the contact regions of the skins 170 and 175. This adhesive surface bond can also be of sufficient strength to maintain the bond between elementary filaments over the course of subsequent treatments and processing. Conversely, these adhesive bonds may not be overly resilient as to prohibit later separation of the filaments as required in subsequent manufacturing steps.

The formation and dimensions of the beads 150 and 155 that form at the exit of the die openings are determined by: the shape and size of the die openings; by the type of polymer(s), or polymer solution(s) extruded from the die; by the pressure, the speed, and the rheological conditions of extrusion and spinning; and by the consolidation conditions. In addition, the bonding forces between elementary filaments can be adjusted by modifying the consolidation conditions.

Figure 2:
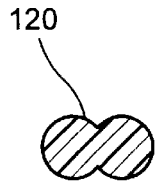
FIG. 2 is a cross-sectional view of a multi-segmented filament produced by the die plate of FIG. 1.

FIG. 2 is a cross-section of a multi-segmented filament manufactured in accord with the methods defined in the first embodiment. As can be seen, this multi-segmented filament 120 has maintained the circular cross-sectional shape of the two elementary filaments that created it.

Figure 3:
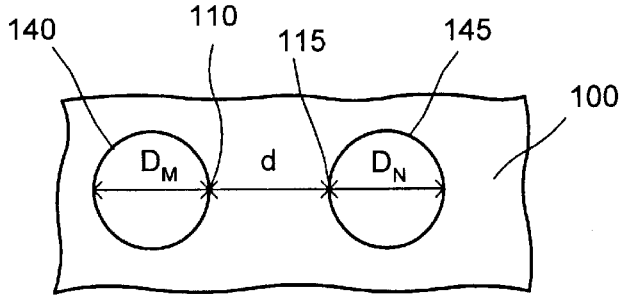
FIG. 3 is an enlarged view of the exit side of the die plate illustrated in FIG. 1.

FIG. 3 is an enlarged view of the openings 140 and 145 in the spinning die plate 100. As can be seen the openings are circular and points 110 and 115 have been identified in FIG. 3 on the circumference of these circular openings. As can also be seen points 110 and 115 mark the closest distance between the two circular openings. This distance is indicated by the lower case roman character "d" in FIG. 3.

FIGS. 4–9 illustrate alternative embodiments of a die plate in accord with the present invention. While these alternative embodiments illustrate complex configurations that may be created in accord with the present invention they are merely examples of various configurations and should not be interpreted as an exclusive list.

Figure 4:
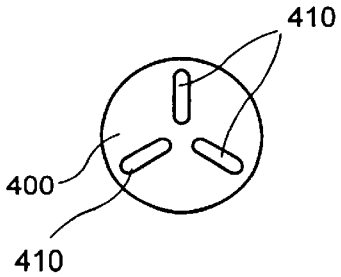
FIG. 4 is an exit side view of a die plate in accordance with a second embodiment of the present invention.

FIG. 4 illustrates the exit face of die plate 400 in accord with a second embodiment of the present invention. As is evident die plate 400 has three oblong openings 410 which may be utilized to produce a three-lobed multi-segment filament.

Figure 5:
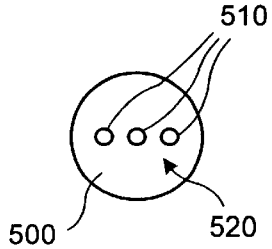
FIG. 5 is an exit side view of a die plate in accordance with a third embodiment of the present invention.

FIG. 5 illustrates the exit face of die plate 500 in conformance to a third embodiment of the present invention. This die plate 500 has three openings 510 all of which comprise one group 520. As is evident each of these openings 510 is circular and may be used to produce a multi-segmented filament in the shape of a strip or film that can be sectioned lengthwise.

Figure 6:
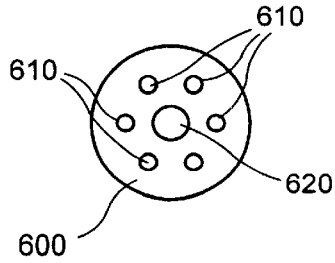
FIG. 6 is an exit side view of a die plate in accordance with a fourth embodiment of the present invention.

FIG. 6 illustrates the exit face of die plate 600 in accord with a fourth embodiment of the present invention. As above, the exit face has a plurality of openings 610 and 620 which constitute one group. This die plate 600 may be used to produce a multi-segmented filament in the shape of a daisy. One advantage of this configuration is that the central opening 620 may be fed one polymer that can be used as a guide filament while the outer openings 610 can be fed a different polymer that may be used to customize the properties of the resulting multi-segmented filament.

Figure 7:
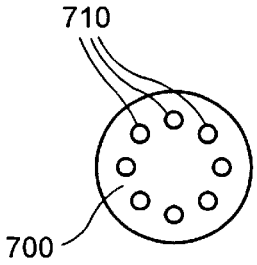
FIG. 7 is an exit side view of a die plate in accordance with a fifth embodiment of the present invention.

FIG. 7 illustrates the exit face of die plate 700 in accord with a fifth embodiment of the present invention. This die plate 700 has a plurality of small circular openings 710 which may be used to produce a multi-segment filament in the shape of a hollow tube.

Figure 8:
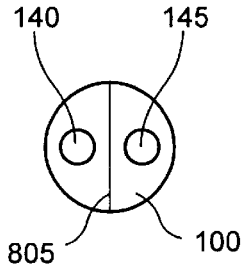
FIG. 8 is an exit side view of the die plate of FIGS. 1 and 3 in accord with a first embodiment of the present invention.

FIG. 8 illustrates the exit face of die plate 100, which is discussed above. As is evident the openings are circular and are mirror images of one another about a center line 805.

Figure 9:
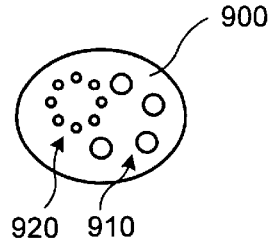
FIG. 9 is an exit side view of a die plate in accordance with a sixth embodiment of the present invention.

FIG. 9 illustrates the exit face of a die plate 900 in accord with a sixth embodiment of the present invention. This six embodiment has a first group of orifices 920 and a second group of orifices 910. In use, this die plate may be used to produce a multi-segmented filament having two hollow tubes with different diameters and may be made of elementary filaments having different properties.

Figure 10:
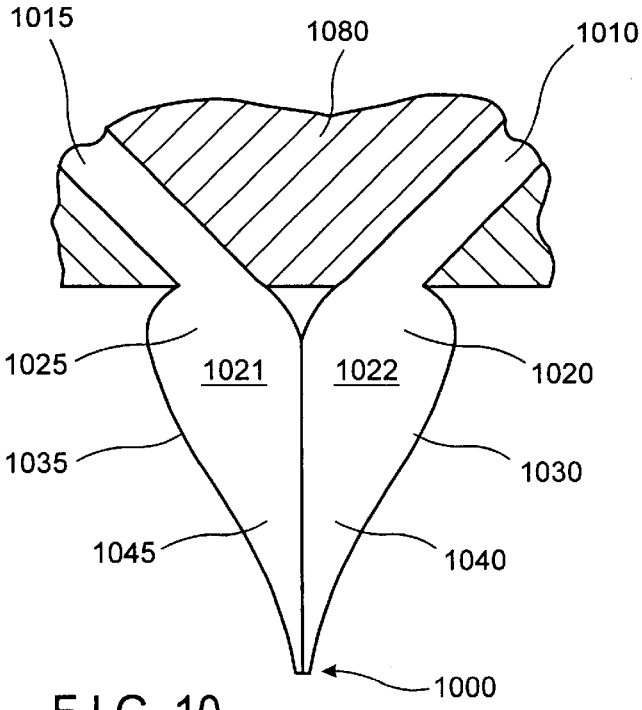
FIG. 10 is a partial cross-sectional view of a die being operated in accord with a seventh embodiment of the present invention.

FIG. 10 illustrates a die plate 1080 in accord with the seventh embodiment of the present invention. As is evident the first opening 1010 and the second opening 1015 are not parallel to one another nor are they perpendicular to the exit face of the die. Also evident in FIG. 10 is: the first bead 1020, the second bead 1025, the skins 1030 and 1035, the first elementary filament 1040, the second elementary filament 1045, and the multi-segmented filament 1000.

As mentioned above, more than one polymer may be fed to and through the die plate 1080 of FIG. 10. For example, in this seventh embodiment polymer 1022, which is emerging from opening 1010, is different from polymer 1021, which is emerging from opening 1015. By utilizing more than one polymer the adhesion qualities of the filaments and well as the final working properties of the multi-segment filament can be adjusted and modified.

Figure 11:
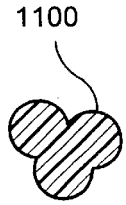
FIG. 11 is a cross-sectional view of a multi-segmented fiber manufactured in accord with an eight embodiment of the present invention.

FIG. 11 illustrates a cross-section of a multi-segmented filament made in accordance with an eight embodiment of the present invention. As is evident, the filament 1100 is clover shaped and comprises three prominent filaments.

Referring back now to FIG. 1, it has been found that for die openings having round or clearly circular cross-sections it is advantageous to have the distance (d) between die openings, in a group of die openings, satisfy the following equation with respect to another die opening in the group:

$$0.5\times(D_n+D_m)/2 \leqq d \leqq 5\times(D_n+D_m)/2, \quad \text{(equation 1)}$$

where n is not equal to m, n varies from 1 to T, m varies from 1 to T, and where T is the total number of die openings of group G, $D_n$ is the diameter of the first die opening, $D_m$ is the diameter of the second die opening, and d is the distance between points 110 and 115 as illustrated in FIG. 1.

In addition, regardless of their shape and using the same variable definitions, it has also been found that it is preferable that each die opening of a group of die openings, satisfies equation 2 with at least one other die opening of the same group:

$$0.5\times(D_n+D_m)/2 \leqq d \leqq 2\times(D_n+D_m)/2. \quad \text{(equation 2)}$$

Two non-exhaustive, exemplary embodiments setting forth suggested rheological conditions are as follows.

EXAMPLE 1

A nonwoven material made of bisegmented endless filaments with a surface mass of 110 g/m$^2$ (NFG 38013) is first produced according to a process that is similar to the one described in the French Patent 7420254.

The configuration of the filaments making up the surface is based on a two-part fiber of 100% PES with a titer of 1.2 dTex before splitting (FIG. 2 is a view of the cross-section of these fibers).

The polymer used (POLYESTER) demonstrates the following properties:

| | |
|---|---|
| Substance | polyethylene terephthalate |
| $TiO_2$ | 0.4% |
| Melting point | 256° C. |
| Viscosity in the melted state | 210 Pa at 290° C. |
| Type and origin | Type 20 from Hoechst |

Conditions of Spinning Extrusion in Example 1

Drying takes place in dry air with a dew point of −40° C. with a dwell time of 3 hours at 170° C. The feed of the extruder takes place in air containing nitrogen.

The spinning unit is circular and contains a die plate that is composed of 240 groups of two openings spaced 0.15 mm apart, with a diameter of 0.2 mm and a height of 0.4 mm.

The melt-extrusion temperature of the polymer is 295° C., the spinning speed is around 4000 m/min, and the output per group is 0.5 g/min (0.25 g/min/capillary).

Consolidation—Bonding Criteria

The surface produced is subjected to hydraulic bonding under jets of 225 bar (twice per side), at a speed of 35 m/min, using spray nozzles of 130 microns. The initial filaments of 1.2 dTex are split into two identical parts of 0.6 dTex.

Characteristic Properties of the Filaments

| | |
|---|---|
| Titer (DIN 53812) | 1.2 dTex |
| Strength | 27 cN/Tex |
| Expansion | 78% |

Characteristic Properties of the Product

| | | | |
|---|---|---|---|
| Dynamometry: | Stress | SL 350 | Algt SL 56% N/5 cm |
| | Stress | ST 300 | Algt SL 62% N/5 cm |
| | Tear strength (NFG07146) | SL 35 N | ST 55 N |
| | Retraction (180°/5 min) | SL-1.8% | ST-2.1% |

EXAMPLE 2

A non-woven material made of endless filaments with a surface mass of 130 g/m$^2$ is produced.

The configuration of the filaments making up the surface is based on a three-lobe distribution, proceeding from three capillaries that belong to one and the same group. FIG. 11 provides a cross-sectional view of these filaments. The three capillaries of one and the same feed die are arranged along the tips of an equilateral triangle with a side length of 0.4 mm. The diameter of a capillary is d=0.25 mm, its height is 2 d, the distance between two capillaries is 0.15 mm.

The polymer used and the extrusion/spinning conditions are identical with those of Example 1.

The output per group is 0.66 g/min (3×0.22 g) and the speed of spinning/stretching is approximately 4500 m/min, resulting in production of a filament at 1.5 dTex.

Consolidation—Fixing

The surface is subjected to double-sided needling at 200 perforations per cm$^2$, using needles with a gauge of 40 RB that penetrate 12 mm.

Characteristic Properties of the Filaments

| | |
|---|---|
| Titer | 1.5 dTex |
| Strength | 31 cN/Tex |
| Expansion | 78% |

Characteristic Properties of the Product

| | | |
|---|---|---|
| Stress | SL 490 N/5 cm | ST 370 N/5 cm |
| Expansion | SL 60% | ST 70% |

Final Processing—Use

The product is then impregnated with an application of 480 g/m$^2$, using a styrene-butadiene resin, and then calendared (calibrated). The end product is intended as reinforcement material for shoes.

Of course the invention is not limited to the implementations described above and shown in the attached drawings. Changes are possible without departing from the spirit and scope of the present invention. For example, although the above embodiments were explained in more detail with regards to hot extrusion of polymers in the melted state, it can also be used for dry spinning processes [solvent+polymer(s):extrusion with evaporation of the solvent] as well as for moist spinning processes [solvent+polymer(s) with die exit in the solvent bath of the solvent]. Moreover, changing the exit orifice diameters of adjacent openings in order to adjust the adhesion characteristics of the filaments may be done while nevertheless remaining within the scope of the present invention. Similarly, the shape of the bead can also be modified to reduce or change the adhesion contact point between the two elementary filaments and the openings may be separated to further adjust the size, shape or formation of the bead.

What is claimed is:

1. A method for producing multi-segmented filaments comprising:

(a) passing a first polymer material into a die, the first polymer material and the die being maintained under predetermined rheological conditions;

(b) extruding the first polymer material through a plurality of die openings in the die, the die openings arranged in a group, the group configured to form at least two elementary filaments, the die openings are further configured such that a bead of the polymer material exiting a die opening in the group contacts with at least one other bead of polymer material exiting another die opening in the group; and (c) connecting the at least two elementary filaments by adhesion contact to form a multi-segmented filament.

2. The method of claim 1 wherein step (b) includes the sub-step of:

(i) forming a skin on the elementary filaments.

3. The method of claim 1 further comprising: p1 (d) stretching the multi-segmented filament.

4. The method of claim 1 wherein the closest distance between a first die opening from the plurality of die openings and a second die opening from the plurality of die openings is equal to or greater than a quarter of the sum of the diameters of the first die opening and the second die opening and is less than or equal to two and a half times the sum of the diameters from the first die opening and the second die opening.

5. The method of claim 1 wherein the closest distance between a first die opening from the plurality of die openings and a second die opening from the plurality of die openings is equal to or greater than a quarter of the sum of the diameters from the first die opening and the second die opening and is less than or equal to the sum of the diameters from the first die opening and the second die opening.

6. The method of claim 1 wherein each of the plurality of die openings are supplied with the first polymer material.

7. The method of claim 1 wherein step (a) further comprises passing a second polymer material into the die under predetermined rheological conditions.

8. The method of claim 7 wherein step (b) further comprises extruding the second polymer material through one of the plurality of die openings.

9. The method of claim 1 wherein once made, the adhesion contact between the first and the second filament is continuous and uninterrupted.

10. The production process according to claim 1 wherein a first die opening from the plurality of die openings determines the adhesion contact point between the first filament and the second filament.

11. A method of manufacturing a textile material comprising:

(a) passing a first polymer material into a die, the first polymer material and the die being maintained under predetermined rheological conditions;

(b) extruding the first polymer material through a plurality of die openings, the die openings arranged in a group, the group configured to form at least two elementary filaments, the die openings are further configured such that a bead of the polymer material exiting a die opening in the group contacts with at least one other bead of polymer material exiting another die opening in the group;

(c) combining, by adhesion contact, the elementary filaments into a second filament having a multi-segmented cross-section; and (d) placing the second filament having a multi-segmented cross-section into a textile material.

12. The method of manufacturing a textile material of claim 11 further comprising, after step (c), the sub-step of:

(i) separating a portion of the second filament into its elementary filaments by mechanical or chemical forces.

13. A method for producing multi-segmented filaments comprising:

(a) passing a first polymer material into a die, the first polymer material and the die being maintained under predetermined rheological conditions, and (b) extruding the first polymer material through a plurality of die openings in the die, the die openings arranged in a group, the group configured to form at least two elementary filaments, the die openings further configured such that a bead of the polymer material exiting a die opening in the group contacts with at least one other bead of polymer material exiting another die opening in the group, each of the plurality of die openings supplied with the first polymer material.

* * * * *